US005551688A

United States Patent [19]

Miller

[11] Patent Number: 5,551,688

[45] Date of Patent: Sep. 3, 1996

[54] MAGNETICALLY DETECTABLE TENNIS BALL

[75] Inventor: R. A. Miller, Simpsonville, S.C.

[73] Assignee: Wilson Sporting Goods Co., Chicago, Ill.

[21] Appl. No.: 861,926

[22] Filed: Apr. 1, 1992

[51] Int. Cl.[6] ..... A63B 61/00

[52] U.S. Cl. ..... 273/61 R; 273/58 G

[58] Field of Search ..... 273/58 R, 61 R, 273/61 B, 61 C, 58 B, 58 BA, 58 G, 58 K

[56] References Cited

U.S. PATENT DOCUMENTS

| | | | |
|---|---|---|---|
| 3,774,194 | 11/1973 | Jokay | 273/31 |
| 3,854,719 | 12/1974 | Supran | 273/58 K |
| 3,883,860 | 5/1975 | von Kohorn | 273/61 R |
| 4,071,242 | 1/1978 | Supran | 273/58 G |
| 4,109,911 | 8/1978 | Van Auken | 273/61 R |
| 4,299,384 | 11/1981 | Van Auken | 273/58 G |
| 4,375,289 | 3/1983 | Schmall | 273/371 |
| 4,664,376 | 5/1987 | Gray | 273/61 R |
| 4,664,378 | 5/1987 | Van Auken | 273/61 R |
| 4,718,670 | 1/1988 | Gray | 273/61 R |
| 5,082,263 | 1/1992 | Berger | 273/61 R |

FOREIGN PATENT DOCUMENTS

| | | |
|---|---|---|
| 83/01904 | 6/1983 | WIPO . |
| 89/00066 | 1/1989 | WIPO . |
| 92/00125 | 1/1992 | WIPO . |

*Primary Examiner*—Steven B. Wong

[57] ABSTRACT

A tennis ball is provided with magnetically detectable properties while still meeting USTA specifications. The magnetic properties are provided by sponge iron powder which is formed from magnetite iron ore. The sponge iron powder is blended with the rubber which is used to mold the core of the ball.

6 Claims, 2 Drawing Sheets

MAGNETICALLY DETECTABLE TENNIS BALL

BACKGROUND

This invention relates to tennis balls, and, more particularly, to a tennis ball with magnetic properties which permit an instrument to detect whether the ball is inside or outside of a boundary line.

A persistent problem in the game of tennis is making accurate and consistent judgments of whether or not the tennis ball is inside or outside of boundary lines on the tennis court. Tennis tournaments use line judges who attempt to make a visual determination of whether the ball is in or out on the service and during subsequent play. However, any person who is even a casual fan of tennis is familiar with the arguments which commonly occur between players and line judges over the correctness of the judge's call. The problem is exacerbated when a line judge'call is overruled by the chair umpire, who presumably does not have as good a view of the line as the line judge.

Attempts have been made to provide automatic detection of whether a tennis ball lands inside or outside a boundary line. For example, some tennis balls have been provided with a metallic device which is intended to close an electrical circuit between wires which are embedded in the court to provide an audible signal when the ball is out. More recently, attempts have been made to provide a magnetically detectable ball which can be sensed by an instrument which measures the magnetic permeability of the ball while in motion.

One such magnetic detection instrument is produced by a company named Tel Pty. Ltd., from 26–28 Fitzroy Avenue, Camden Park 5038, South Australia. Although the details of the manner in which the instrument operates are not known, it is believed that the instrument measures the magnetic flux or magnetic permeability of a ball which has ferromagnetic permeability incorporated in it. According to published information from Tel, the Tel detection system has four components: antenna arrays buried below the court lines which transmit and receive data, an instrument box holding 13 computers (one for each line), a hand-held computer operated by the chair empire, and tennis balls which contain metal particles embedded in the rubber core. When a moving tennis ball is within about four inches above a line, an electronic signal is produced because the magnetic particles in the ball disturb the magnetic field above the line. The Tel system provides information on ball velocity, approach trajectory angle, elevation and position of the centroid of the ball footprint relative to the outer edge of a court line. This information is used by the 13 computers to make in and out decisions, although during play the system makes only out decisions audibly.

One prior art tennis ball which was used with the Tel instrument used an iron powder obtained from AEM Cores Pty. Ltd., Bedford Street, Billman, South Australia 5013 under the name Telsen. The powder had a specific gravity of 7.65.

Tennis balls which incorporated the Telsen powder did not meet the specifications for use with the Tel instrument and did not meet the specifications of the United States Tennis Association (USTA). The average magnetic reading level met the Tel specification, but the range of the readings was too great (88% of the balls failed to meet the specification). The Tel specifications are a total magnetic permeability of greater than 0.6 with a variance (variation in the uniformity of distribution of the magnetic permeability) less than 0.60 as measured by the Tel instrument. The balls did not meet USTA specifications because their deflection was too soft.

USTA specifications for a tennis ball provide that the ball shall have a uniform outer surface, be white or yellow in color, have a diameter of more than 2½ inches (6.35) and less than 2⅝ inches (6.67 cm), and have a weight more than 2 ounces (56.7 grams) and less than 2 1/16 ounces (58.5 grams). The ball shall have a bound of more than 53 inches (135 cm) and less than 58 inches (147 cm) when dropped 100 inches (254 cm) upon a concrete base. The ball shall have a forward deformation of more than 0.220 inch (0.56 cm) and less than 0.290 inch (0.74 cm) and a return deformation of more than 0.350 inch (0.89 cm) and less than 0.425 inch (1.08 cm) at 18 lb. (8.165 kg) load. The deformation figures shall be averages of three individual readings along three axes of the ball and no two individual readings shall differ by more than 0.030 of an inch (0.08 cm) in each case.

SUMMARY OF THE INVENTION

The invention provides a magnetically detectable tennis ball which meets both USTA specifications and the specifications for use with the Tel instrument. The tennis ball uses a sponge iron powder which is obtained from magnetite iron ore. The iron powder is incorporated into the rubber core of the ball. The iron powder makes the rubber core softer, so only No. 3 Ribbed Smoke Sheet Rubber is used for the core. No. 3 Ribbed Smoke Sheet gives a lower deflection than Standard Indonesian Rubber, which is conventionally used for tennis ball cores alone or in combination with No. 3 Ribbed Smoke Sheet.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
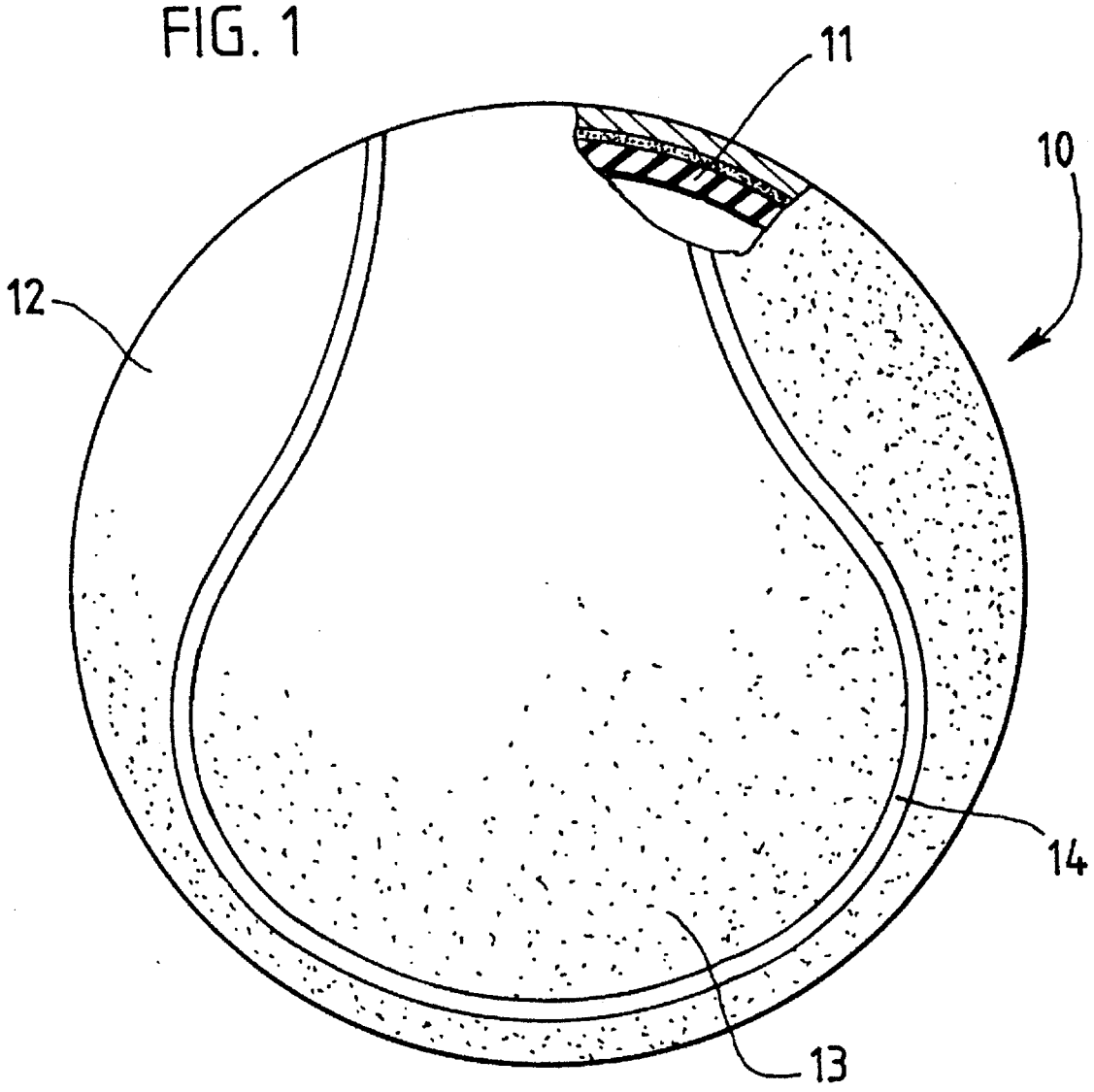
FIG. 1 illustrates a tennis ball, partially broken away, which is formed in accordance with the invention.

Referring to FIG. 1, a tennis ball 10 comprises a core 11 and a cover 12. The core 11 is hollow sphere which is molded primarily from rubber and which includes sponge iron powder formed from magnetite iron ore to provide the ball with ferromagnetic properties. The cover 12 is conventional and includes a pair of dumbell or FIG. 8 shaped pieces of felt 13 which are adhesively secured to the core. A seam 14 of adhesive surrounds the peripheries of the felt pieces.

The preferred composition of the magnetic core 11 is set forth in Table I and is compared with a typical prior art ball which does not have magnetic properties.

TABLE I

| Ingredient | Magnetic Core (parts by weight per 100 parts of rubber) | Non-Magnetic Core (parts by weight per 100 parts of rubber) |
|---|---|---|
| No. 3 Ribbed Smoke Sheet Rubber | 100 | |
| Standard Indonesian Rubber 10 | | 100 |
| stearic acid | 1.50 | 1.38 |
| retarder W | 1.00 | 0.75 |

TABLE I-continued

| Ingredient | Magnetic Core (parts by weight per 100 parts of rubber) | Non-Magnetic Core (parts by weight per 100 parts of rubber) |
|---|---|---|
| 4,4-dithiodimorpholine | 1.00 | 0.75 |
| Rubber maker's sulfur | 3.60 | 3.00 |
| sulfenamide | 2.25 | 2.25 |
| 90% methyl zimate | 0.15 | |
| butaraldehyde aniline | 0.25 | |
| antioxidant | 0.50 | 0.50 |
| process oil | 1.00 | 11.00 |
| precipitated silica | 3.00 | |
| zinc oxide | 4.00 | 22.75 |
| modified kaolin clay | 72.00 | |
| metal powder | 29.00 | |
| diorthotolyl guanidine | | 0.10 |
| magnesium carbonate | | 29.00 |
| precipated hydrated amorphous silica | | 2.50 |
| kaolin clay | | 30.00 |
| Mercapto-terminated kaolin clay | | 20.00 |

With the exception of the metal powder, the foregoing ingredients are conventional and well known to manufaturers of tennis balls. Some prior art tennis ball cores also use No. 3 Ribbed Smoke Sheet rubber in combination with Standard Indonesian Rubber.

The specific metal powder used was obtained from Hoeganaes Corporation of Riverton, N.J. under the name Ancor MH-100. Ancor MH-100 is a sponge iron powder which is made from magnetite iron ore. The iron ore is reduced directly at elevated temperatures to obtain sponge iron which is disintegrated into powder. Final properties are obtained by annealing. Sponge iron powder has very high surface area and exhibits high green strength. Ancor MH-100 sponge iron powder has the properties listed in Table II.

TABLE II

| | |
|---|---|
| Apparent Density (weight of a unit volume of powder) | 2.50 g/cm$^3$ |
| Chemical Analysis % | |
| Fe | 98.2 |
| $SiO_2$ | 0.20 |
| C | 0.02 |
| $H_2$ - Loss | 0.35 |
| S | 0.01 |
| P | 0.01 |
| Flow (Hall Flowmeter) | 30 seconds for 50 gm. |

Sieve Analysis, %

| U.S. Standard Mesh | % |
|---|---|
| +80 (177 micron) | 1 |
| −80 + 100 (149 micron) | 4 |
| −100 + 140 (106 micron) | 20 |
| −140 + 200 (074 micron) | 27 |
| −200 + 325 (044 micron) | 24 |
| −325 | 24 |

Compacting at 30 tons per square inch (with 1% zinc stearate added)

| Density g/cm$^3$ | Green Strength psi | Briquette Strength Newtons per square millimeter |
|---|---|---|
| 6.4 | 2000 | (13.8) |

Figure 2:
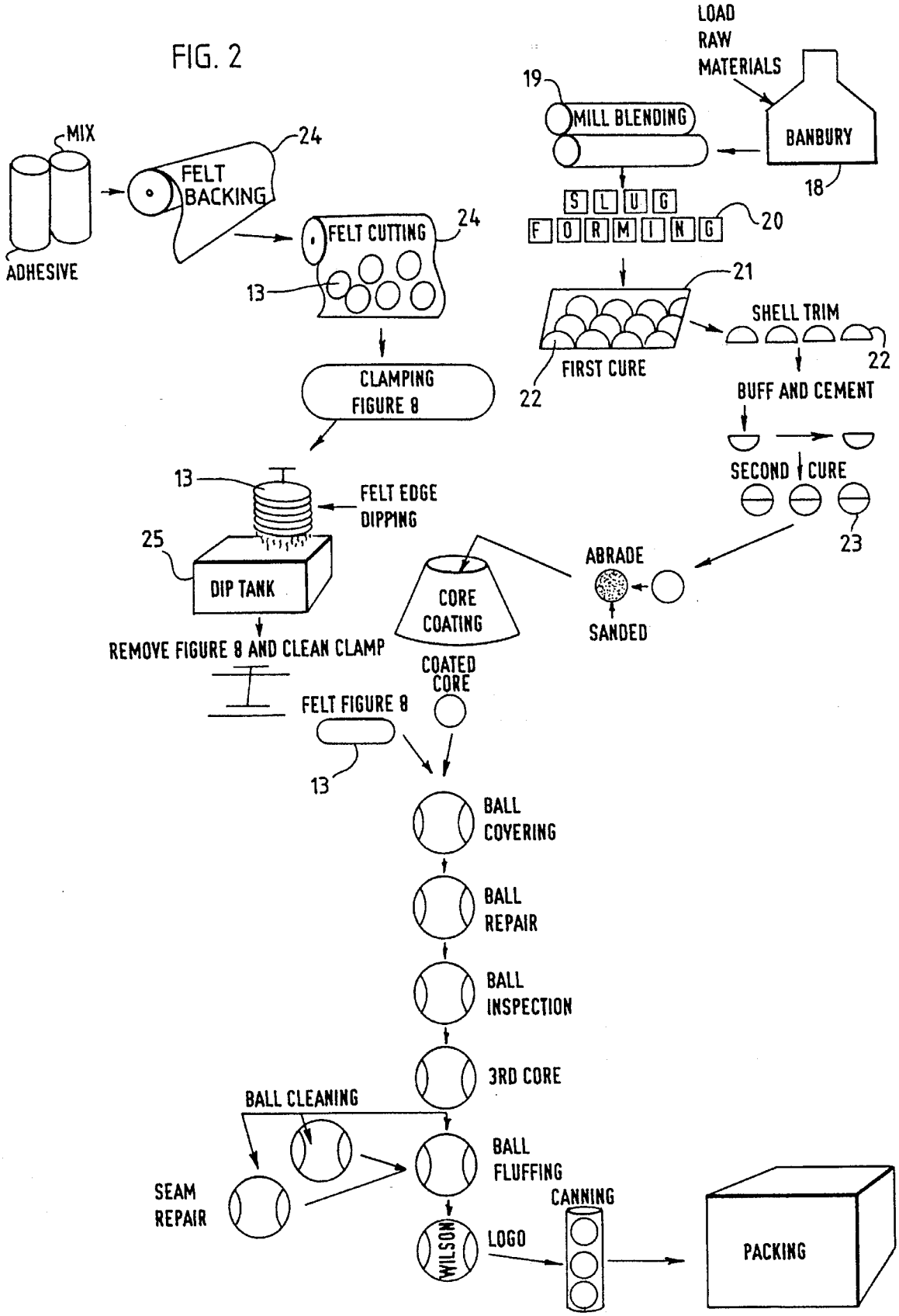
FIG. 2 is a schematic illustration of the steps of forming the ball.

The process of manufacturing the magnetic tennis balls is illustrated in FIG. 2. Except for the addition of the iron powder, the manufacturing steps are conventional.

The rubber is loaded first into a Banbury mixer 18, and one minute later the other ingredients of the core are loaded into the Banbury. The ingredients are mixed for an additional 5 minutes, and the speed of the Banbury is adjusted to maintain the temperature at a maximum of 220° F.

The sheets of rubber compound formed by the Banbury are broken down and blended on a rubber mill 19, and thereafter the material is fed through an extruder which forms rubber slugs 20. The slugs are molded into sheets 21 which contain hemispherical half shells 22 at the stage labeled First Cure.

The next step is Shell Trim where the flash is cut away from the half shells. At Buff and Cement the edges of the half shells are sanded, and adhesive is applied. At Second Cure the half shells are joined to form cores 23. The cores are abraded and sanded and then dipped in adhesive at Core Coating. The coated cores then go to Ball Covering where the FIG. 8 pieces of felt are applied to the cores.

The felt processing is shown in the upper left of FIG. 2. Adhesive is applied to a felt sheet 24 at Felt Backing, and the FIG. 8 pieces are cut at Felt Cutting. For ease of illustration the FIG. 8 pieces are shown as ovals in FIG. 2. A plurality of FIG. 8 pieces are clamped together and dipped in felt edge adhesive in dip tank 25.

The cores are covered with felt at Ball Covering, and after Ball Repair and Ball Inspection the covered core is placed in a press at 3rd Cure which applies heat to cure the adhesives. The felt is fluffed at Ball Fluffing, markings are applied at Logo, and the finished balls are packaged at Canning and Packing.

Balls made in accordance with the invention meet all USTA specifications and also meet the specifications for use with the Tel instrument. The magnetic permeability of the balls can be detected by the instrument to provide an automatic indication of whether the ball lands outside of a service line, base line, or side line.

Adding the iron powder to the core makes the ball softer. Accordingly, the preferred embodiment uses only No. 3 Ribbed Smoke Sheet Rubber, which is harder than Standard Indonesian Rubber.

Although the preferred composition of the core uses 29 parts of sponge iron powder per 100 parts of rubber, we have had successful results using between 29 and 39.08 parts of sponge iron powder per 100 parts of rubber.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A magnetically detectable tennis ball which meets USTA specifications comprising a rubber core and a felt cover surrounding the core, the core including magnetite iron ore in the form of sponge iron powder.

2. The tennis ball of claim 1 in which the iron powder has a density of about 6.4 grams per cubic centimeter when compacted under 30 tons per square inch.

3. The tennis ball of claim 1 in which the iron powder has a carbon content of about 0.01%.

4. The tennis ball of claim 1 in which the core includes about 29 parts by weight of iron powder per hundred parts by weight of rubber.

5. The tennis ball of claim 1 in which the core includes from about 29 to about 39 parts by weight of iron powder per hundred parts by weight of rubber.

6. The tennis ball of claim 4 in which the rubber of the core is No. 3 Ribbed Smoke Sheet.

* * * * *